US008156987B1

(12) United States Patent
Lewis

(10) Patent No.: US 8,156,987 B1
(45) Date of Patent: Apr. 17, 2012

(54) AUTOMATIC HIGH-SPEED CONTAINER LABELLING MACHINE

(76) Inventor: Graham Louis Lewis, Vaudreuil-Dorion (CA)

( * ) Notice: Subject to any disclaimer, the term of this patent is extended or adjusted under 35 U.S.C. 154(b) by 397 days.

(21) Appl. No.: 12/267,428

(22) Filed: Nov. 7, 2008

(51) Int. Cl.
*B65C 9/04* (2006.01)

(52) U.S. Cl. ..... 156/446; 156/449; 156/450; 156/455; 156/458; 156/566; 156/568

(58) Field of Classification Search ..... 156/446, 156/449, 450, 455, 458, 566, 568, 448, 215, 156/136.1, 415
See application file for complete search history.

(56) References Cited

U.S. PATENT DOCUMENTS

| | | | | |
|---|---|---|---|---|
| 4,083,389 | A * | 4/1978 | Rosen et al. | 141/179 |
| 4,428,474 | A * | 1/1984 | Gau et al. | 198/394 |
| 4,714,515 | A * | 12/1987 | Hoffmann | 156/450 |
| 4,931,122 | A | 6/1990 | Mitchell | |
| 5,028,293 | A * | 7/1991 | Harvey | 156/449 |
| 5,082,520 | A * | 1/1992 | West et al. | 156/450 |
| 6,494,238 | B2 * | 12/2002 | Sindermann | 141/6 |
| 6,793,755 | B2 * | 9/2004 | Schaupp et al. | 156/215 |

OTHER PUBLICATIONS

Aesus Premier Wrap, 20060621, Aesus Labelling Systems, 686 Victoria St., Baie D'Urfe, Quebec, H9X 2K2 Canada.

Aesus Premier Star Wrap, 20080122, Aesus Labelling Systems, 686 Victoria St., Baie D'Urfe, Quebec, H9X 2K2 Canada.

* cited by examiner

*Primary Examiner* — Khanh P Nguyen
*Assistant Examiner* — Keith Aziz
(74) *Attorney, Agent, or Firm* — Richard L. Marsh

(57) ABSTRACT

A container labeling machine comprises a conveyor, a pressure sensitive label applying apparatus, a star wheel and at least one indexing mechanism, the conveyor supplying containers to the star wheel and taking away the containers upon release from the star wheel. The star wheel is fitted with rollers at the apices of points of the star wheel, the star wheel receiving containers between the rollers of adjacent apices. The label applying apparatus is adapted to apply the label to the container and rotate the container within the star wheel to adhere the label to the container. The indexing mechanism aligns the star wheel to present the container into a perpendicular relation with the label applying apparatus and retains the container in the perpendicular relation until the label is adhered to the container, the indexing mechanism releasing the star wheel allowing the container carrying the label to the conveyor. The apparatus further can comprise control means for timing the label applying apparatus so that it will commence the application precisely with respect to a witness mark on the container. The apparatus further can comprise control means for timing the label applying apparatus so that it can dispense two (or more) labels onto the same container in varying positions (for example separate front and back labels), before releasing the said container.

16 Claims, 2 Drawing Sheets

AUTOMATIC HIGH-SPEED CONTAINER LABELLING MACHINE

BACKGROUND OF THE INVENTION

1. Field of the Invention

This invention pertains to automatic high-speed self-adhesive labeling machines. More particularly, the present invention relates to automatic high-speed labeling machines for labeling cylindrical containers which are linearly fed through the machine in a straight line, but are caused to rotate about their vertical axes through three points of contact with a powered rotating belt (or wheel or drum) and two passive rollers held at the apex of a freely rotating star wheel which results in the transfer of at least one label to a container and thereby causing the container to wrap the label around itself.

2. Description of the Prior Art

The prior art is replete with descriptions of labeling machines for cylindrical containers which all accomplish the same purpose but by different means.

For example, in U.S. Pat. No. 4,714,515 (1987), Hoffman describes a "straight line" container labeling apparatus including oppositely moving main drive and porous labeling belts, and a timing star and second star wheel having rollers on the ends of its arms for engaging and aligning each container while allowing it to rotate freely between the belts. In this apparatus, the leading edge of a continuous strip of label stock is gripped by a radially retracted vacuum pad located on the periphery of a rotating vacuum drum and pulled until a cutting knife carried directly on the drum severs the trailing edge of each label. The retracted vacuum pads are selectively extendable for application of adhesive and then may be retracted to allow fingers to strip each gummed label from the drum and transfer it to a vacuum wheel over which is entrained a porous labeling belt that carries each label to a container driven by the drive belt and aligned by the second star. Although workable in theory, this fairly complex labeling apparatus obviously required critical synchronization of its interrelated elements to function properly. During high speed labeling operations (more than 125 containers per minute) several problems arose. For example, containers would often jam as they left the timing star and became wedged by an arm of the aligning star. Additionally, the reciprocating vacuum pads on the vacuum drum did not provide a uniform glue pattern on the labels which often caused glue to be deposited on the porous labeling belt resulting in labels stuck thereon. Moreover, part of the cutting means was located on the periphery of the vacuum drum which, of course, increased in rotational speed with the speed of the labeling operation, and often resulted in improperly cut labels. Thus, the labeling apparatus as above described was short lived in actual high speed production and is not known to be in use today. This method disclosed a star wheel with small rollers (bearings) only at the top and/or at the bottom of the container to assist in the stability and the guiding the containers but this star wheel is powered by the system and is continuously rotating by necessity as this is a continuous motion machine, hence is a complex and expensive system.

In U.S. Pat. No. 4,931,122 (1990), Mitchell discloses another straight through labeling machine with a "feed-screw" for moving cylindrical containers past, but in tangent to, a vacuum drum containing precut gummed labels. The containers travel along a guide-way to the feed screw where they also contact an endless belt causing the containers to spin counter-clockwise around their vertical axes. As the feed screw advances the containers linearly past, but in tangent to, the vacuum drum, a label is transferred to a container and is preferably wrapped around it before said container exits the feed screw. Although this labeling machine appears to be an improvement over the cited prior art, the counter-clockwise rotation of the containers while being linearly advanced within the feed screw causes vertical drag or a retarding force acting on the containers due to friction which is undesirable in high speed labeling operations. Although the feed screw has the effect of aligning the containers vertically, the alignment is only between the root of the screw and the rotating drum, which alignment is improved only by constraining the containers more and more which has adverse effect of jamming the labels as the constraints are tightened.

In U.S. Pat. No. 4,428,474 issued on Jan. 31, 1984 to Gau, et al., disclose an apparatus for aligning containers in a labeling machine. The apparatus comprises pairs of moveable arms, adjacent container pockets on a star wheel, and a belt carried on the arms. The belt is rotated by a motor which, in turn, causes a container in the star wheel pocket to rotate. A sensor detects marks on the containers and applies a brake to stop rotation of the belts, thereby locking the containers in a pre-determined angular orientation. While this would rotate containers and stop them at an appropriate position for labeling with respect to a witness mark on the container, the system is complex and expensive.

Aesus literature Premier wrap 20060621 discloses a system of rollers which index forwards and backwards, while capturing containers against a rotating wrap belt into a position to appropriately apply a pressure sensitive label. This system adequately grips the container, holds it correctly in a vertical axis, allows time for the container to rotate (if required) to a location where the label should be applied relative to a witness mark (seam, spot, or other witness mark) and then signals the label head to dispense the label (or labels) while the container continues to be rotated and held aligned in the vertical axis. Although the system works well, it is limited in speeds to approximately 50 containers per minute.

Aesus literature Premier star wrap 20080122 describes a system of a continuously rotating star wheel that has rollers at the apex of the star wheel which hold the container against a wrap belt similarly, with the whole system being driven by servomotors that are synchronized in order to position the container at the precise point where label needs to be applied. This system works at speeds greater than 50 containers a minute even to speeds in excess of 300 containers per minute, but the combination of servomotors and precise controls making a costly and unaffordable solution for many labeling applications, and it does not have the capability of applying more that one sequential label (ie: separate front and back labels) to each container as the container is continuously moving away from the label dispensing apparatus.

SUMMARY OF THE INVENTION

What is needed in the industry is a system that can present the container to the label dispenser at speeds greater than 50 containers per minute, be able to hold the container precisely in the vertical axis, allow the rotation of the container to a witness mark (if required), to subsequently signal the label dispenser to dispense the label or labels, then continue to hold the container rotating in the vertical axis until the label has finished dispensing and then release the correctly and accurately labeled container, the system manufactured in a simple and affordable configuration.

The present invention overcomes the disadvantages and limitations of the prior art by providing a high speed inline machine to assemble labels onto cylindrical container that can be applied with respect to a witness mark (seam, spot or other witness mark) or simply applied to a regular cylindrical container, at speeds over 50 containers per minute.

Well known in the industry are label dispensing devices which dispense pressure sensitive labels by feeding them off the end of their dispense blade/plate at speeds as fast as 160 meters per minute. (Greater than 8 feet per second). Once the label comes off the dispensing plate it needs to coincide precisely with the container that is being labeled. In the instance of a cylindrical container, if the container is not held precisely in the vertical axis and it is not rotated at the same speed at which the label is being dispensed problems will occur. Either the label will be severely wrinkled, or if the container is not held correctly in the vertical axis the label will spiral onto the container, both instances being unsatisfactory as a final product.

DETAILED DESCRIPTION OF THE INVENTION

Figure 1:
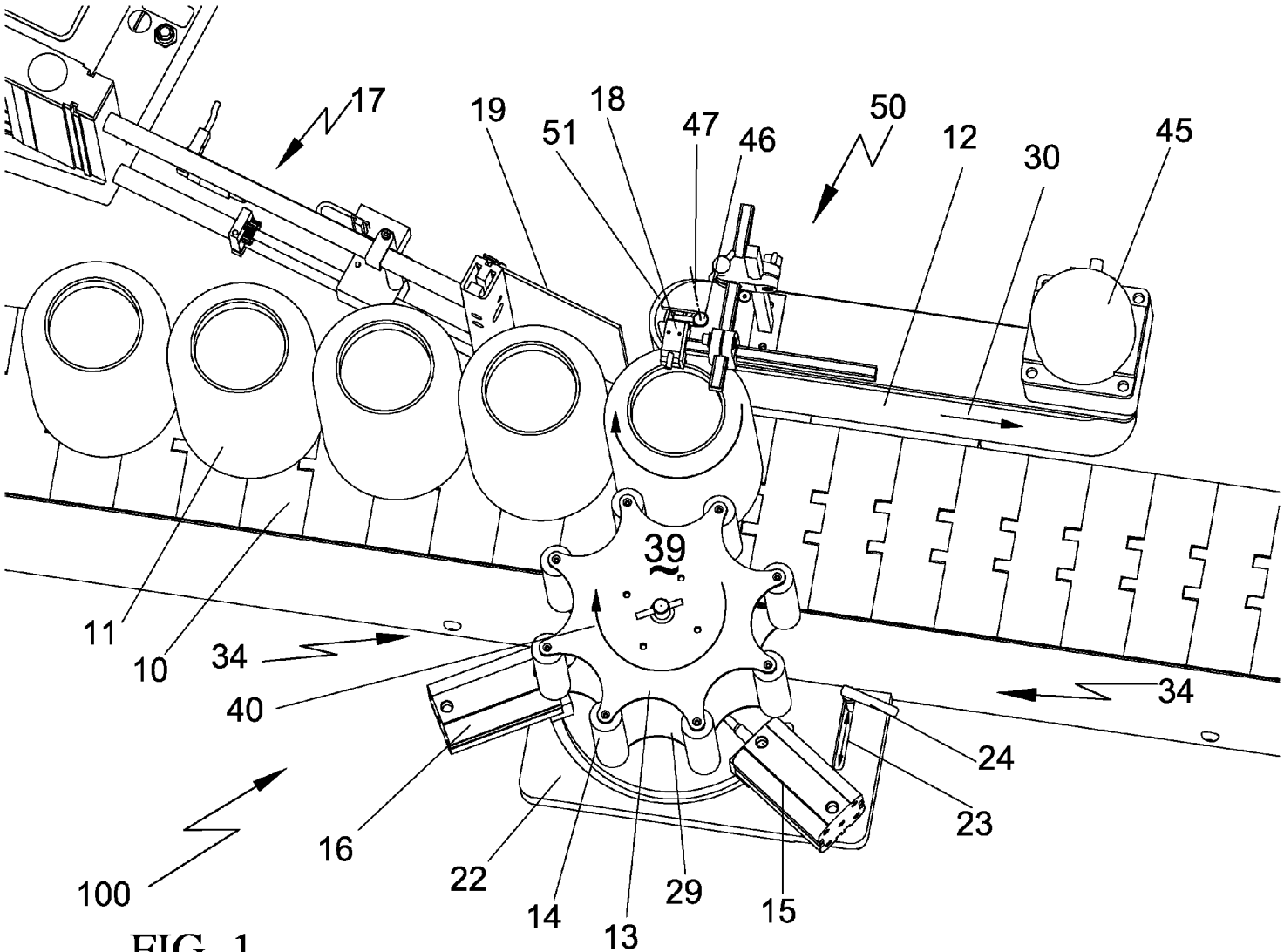
FIG. 1 is upper right perspective of the star wheel labeler of this invention.
Figure 2:
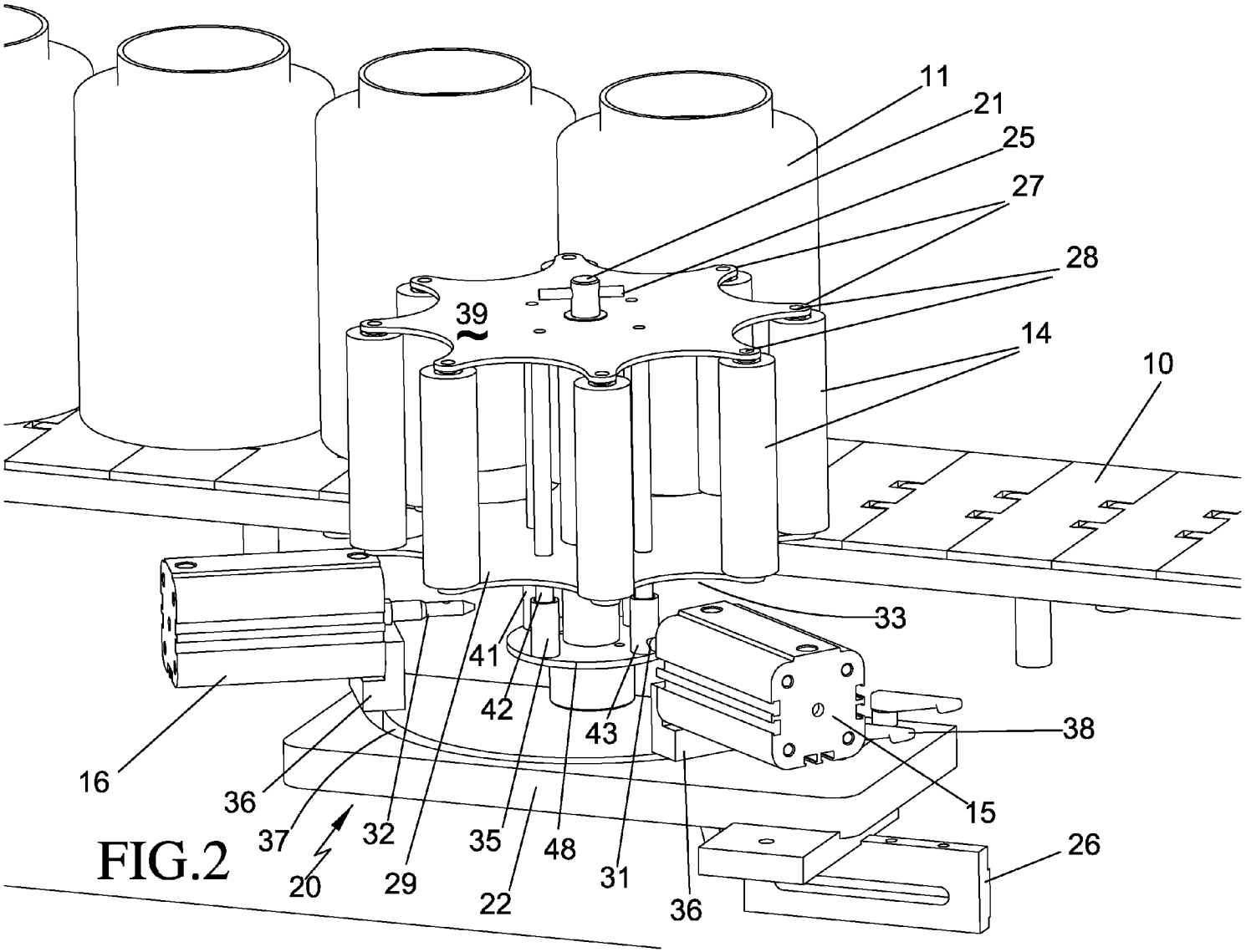
FIG. 2 is an enlarged frontal right perspective of the star wheel labeler of FIG. 1.

Referring to FIG. 1, a star wheel labeling machine is generally shown with the numeral 100 and consists of a conveyor 10, a labeling dispensing device 17, a powered wrapper 50 and an indexing mechanism 20. Referring also to FIG. 2, indexing mechanism 20 further comprises a star wheel 13 rotatably mounted on a shaft 21, shaft 21 journaled in an adjustable table 22 which is also adjustably mounted on a longitudinal slide 26, longitudinal slide 26 made fast to a framework (not shown) of labeling machine 100. Conveyor 10 presents containers 11 in linear fashion to star wheel 13, labeling dispensing device 17 and wrapper 50, labeling device 17 positioned linearly adjacent to powered wrapper 50 near one edge of conveyor 10 while star wheel 13 is mounted relative to table 22 adjacent or overlapping an opposed edge of conveyor 10 and directly opposite powered wrapper 50. Shaft 21 of star wheel 13, a dispense blade 19 of labeling dispensing device 17 and an axis 47 of a spindle 46 of wrapper 50 are positioned vertically, or at 90° to conveyor 10. As wrapper 50 and label dispensing device 17 are mounted opposite star wheel 13, containers 11 are captured between two adjacent rollers 14 and wrapper 50. Rollers 14 are journaled in apices 27 of a base plate 29 and a top plate 39 of star wheel 13, rollers 14 free to rotate independently upon respective spindles 28. Generally, rollers 14 are roughly the height of a label to be dispensed by label dispensing device 17. Thus, it should be readily apparent that star wheel 13 is configured to suit a particular size of container 11 although one star wheel 13 may handle a range of diameters of containers 11. It should also be apparent that since star wheel 13 is rotatably mounted to shaft 21, star wheel 13 may be replaced with a different size star wheel 13 for a different range of containers 11 by removing retainer 25 from shaft 21, removing the installed star wheel 13, mounting a different star wheel 13 to shaft 21 and thereafter retaining the different star wheel 13 upon shaft 21 with retainer 25. Star wheel 13 is preferably supported above adjustment table 22 upon a collar 48, collar 48 separated from base plate 29 of star wheel 13 by pins 41-44. Pins 41-44 are attached to an underside 33 of base plate 29 of star wheel 13, pins 41-44 used to stop star wheel 13 from rotating thus indexing containers 11 in position for application of at least one label from label dispenser 17. There are usually half as many pins 41-44 as there are pockets 34 between adjacent rollers 14 on star wheel 13. In the preferred embodiment depicted in FIGS. 1 and 2, four pins 41-44 and eight pockets 34 are shown, however, it should be understood that a different number of pins 41-44 and pockets 34 may be provided in star wheel 13 without departing from the scope of this invention. Mechanically or pneumatically operated fingers 31, 32 are alternately engaged against an outside surface 35 of pins 41-44 to stop freely rotating star wheel 13 from turning when at least one finger 31, 32 is actuated to interfere with the movement of pins 41-44.

Fingers 31, 32 protrude from indexing cylinders 15, 16 respectively, indexing cylinders 15, 16 independently operated. In operation of star wheel labeler 100, weight of containers 11 on conveyor 10 typically is enough to rotate star wheel 13 in the direction of rotational arrow 40 when container 11 presses against one roller 14 while moving along with conveyor 10. Rotation of star wheel 13 is stopped as one finger 31, 32 extends from its respective indexing cylinder 15, 16 upon command from a controller (not shown) and is engaged by one pin 41-44 rotating thereagainst, thus interference by finger 31, 32 with one pin 41-44 stopping rotation of star wheel 13 and aligning one pocket 34 directly opposite wrapper 50. At that time container 11 will be spinning by action of wrapper 50 pressing against container 11, container 11 captured between wrapper 50 and rollers 14 on star wheel 13. Coincidentally, either label dispensing device 17 dispenses at least one label, or waits momentarily until a signal from a sensor 18 which recognizes a container 11 in proper position and/or a witness mark on container 11 (if so required) thereafter causing label dispensing device 17 to dispense a label. Once the label has been dispensed and container 11 rotated through an arc at least equal to the length of the label to fully press the label against container 11, the engaged finger 31, 32 retracts and the retracted finger 32, 31, which is positioned to allow rotation of star wheel one pocket 34 distant, extends thus allowing star wheel 13 to rotate one pocket 34, star wheel 13 being pushed by the weight of containers 11 on conveyor 10. For instance, referring to FIG. 2, finger 31 is shown bearing against pin 43 while finger 32 is shown retracted, however, before star wheel 13 rotates after application of a label to container 11 captured in star wheel 13, finger 32 will extend such that it will bear against pin 42 when finger 31 is retracted. It should be readily apparent that the cycle continues until all containers 11 in the queue upon conveyor 10 have been labeled. Indexing cylinders 15, 16 carrying fingers 31, 32 respectively, are adjustable upon table 22 so that the stop position of star wheel 13 can be adjusted for a preferred labeling position for container 11 and for use with star wheels 13 having a different number of pockets 34. Still referring to FIG. 2, indexing cylinders 15, 16 are mounted to slide blocks 36, slide blocks 36 adjustably mounted in a curved slot 37 disposed in table 22. Slide blocks 36 are be fixed in position for each set up with a locking handle 38 shown adjacent indexing cylinder 15. For proper operation, indexing cylinders 15, 16 are preferably spaced circumferentially within slot 37 at an angle equal to 360 degrees divided by the number of pockets 34 on star wheel 13 such that fingers 31, 32 stop star wheel 13 at an exact location for application of a label. Although it is within the scope of this invention to have one finger 31, 32 and one pin 41-44 for each pocket 34, this would require that finger 31 or 32 retract and then re-extend very quickly, hence the preferred embodiment is to have two fingers 31, 32 and half the number of pins 41-44 as pockets 34. Though not usually necessary, should containers 11 be empty or extremely light, star wheel 13 may be assisted in its rotational movement with any number of devices including air pressure, motorized assist with a slip clutch, or other devices which would help rotate star wheel 13, but still allow it to be stopped by fingers 31, 32 engaged against pins 41-44. Indexing mechanism 20 may also be adjusted by moving table 22 laterally inwardly or outwardly as shown by an adjustment arrow 23 to adjust for different diameters of containers 11. Table 22 is preferably locked in lateral position by a locking handle 24.

As conveyor 10 transports cylindrical containers 11 in a linear queue, it should be readily apparent that the large, complicated container capturing systems of the prior art are rendered unnecessary. Cylindrical containers 11 remain in a straight line from the entering queue, through the labeling process an onto the take away queue. Wrapper 50 may be a continuous moving wrapping belt 12 trained around spaced apart drums, such as drum 51, or may be comprised of a single drum 51 powered by a prime mover 45. In the preferred embodiment, wrapper 50 comprises continuously moving wrapping belt 12 trained around drums and powered by prime mover 45, continuously moving wrapping belt 12 moving in a direction indicated by directional arrow 30 thus providing spinning rotation to containers 11 when contacted thereby. Containers 11 are stopped approximately in line with spindle 46 of drum 51 and are held in that position by a pocket 34 on star wheel 13, pocket 34 established by a cusp between apices 27 of star wheel 13, apices 27 provided with rollers 14 on apices 27 thereof. Star wheel 13 could freely rotate, driven solely by containers 11 traveling in a straight line except star wheel 13 is held in position by either indexing cylinder 15 or indexing cylinder 16, which alternately engage and disengage to enable star wheel 13 to move one pocket 34 at a time. When container 11 is in the appropriate position as detected by sensor 18, label dispenser 17 will dispense at least one label. The label has a leading edge tacked to container 11 by dispense blade 19 on label dispenser 17 and, as container 11 will be spinning, because it is held in position by rollers 14 and spinning wrap belt 12, the label will be wrapped around container 11 and firmly adhered thereto by the pressing action of the three contact points. When label dispenser 17 has finished dispensing labels, cylinder 15 (or 16) retracts and cylinder 16 (or 15) will engage, allowing star wheel 13 to rotate one pocket 34 containing the next container 11 in the linear queue. Though the figures show eight cusps or pockets 34, it is fully understood that star wheel 13 may have at least three cusps, more preferably an even number between four and twenty four cusps.

This system also enables the possibility of placing two or more labels on the same container 11 while container 11 is rotating in its pocket 34. Label dispensing device 17 can carry two or three or more different labels, which labels can be dispensed one after the other, at an appropriate time delay while container 11 is still held in its pocket 34. Once the appropriate number of labels have been dispensed, star wheel 13 would be allowed to rotate, and the operation will be repeated on the next container 11. For instance, sensor 18 may be used to detect an edge of a previously applied label, recognizing the edge as an indexing mark and rotate container 11 through a specified angle before dispense blade 19 applies a subsequent label to container 11. It is also possible for multiple labels on a single backing tape to be applied to container 11 by repeated strokes of dispense blade 19 which tacks each label in sequence to container 11. Though in the preferred embodiment, conveyor 10 is horizontal and star wheel 13 and wrapper 50 ensure that container 11 is held perfectly at a right angle to conveyor 10 it is possible within the scope of this invention to orient star wheel labeler 100 at another designated angle with respect to horizontal, containers 11 supported by a shoe alongside containers 11.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. A container labeling machine comprises a single horizontal conveyor, a label applying apparatus, a star wheel, a wrapper and at least one indexing mechanism, said single horizontal conveyor linearly supplying upright containers to said star wheel and taking away said upright containers linearly upon release from said star wheel, said star wheel comprising a pair of parallel spaced apart plates affixed to a central axle, said spaced apart plates fitted with a plurality of rollers journaled only in said spaced apart plates, said rollers disposed at the apices of points of said star wheel, said apices of points of said star wheel defining pockets therebetween, said star wheel receiving said upright containers between said rollers of adjacent apices, said indexing mechanism comprising a plurality of stop pins alternately engaged by independently operating fingers thus directly controlling a start and stop action of said star wheel and directly aligning said star wheel to present said upright container into a perpendicular relation with said label applying apparatus and retaining said upright container in said perpendicular relation against a wrapping belt of said wrapper wherein said indexing mechanism has said plurality of stop pins disposed circumferentially about said central axle and on an underside of one said parallel plate of said star wheel, said plurality of said pockets greater in number than said stop pins by a factor of two, said wrapping belt perpendicular to said conveyor and moving in the same direction as said conveyor, said label applying apparatus adapted to apply at least one label to said upright container in a bight between said upright container and said wrapper, said wrapper rotating said upright container only within said star wheel to adhere said label to said upright container, said indexing mechanism releasing said star wheel allowing said upright container carrying said label to move along said conveyor.

2. A container labeling machine as in claim 1 wherein said star wheel rotates freely upon an axle supported on an adjusting table.

3. A container labeling machine as in claim 2 wherein said adjusting table is movably mounted to a frame of said labeling machine.

4. A container labeling machine as in claim 3 wherein said wherein said adjusting table is adapted to move said axle longitudinally along said conveyor.

5. A container labeling machine as in claim 4 wherein said adjusting table is adapted to move said axle inwardly and outwardly from said label applying device.

6. A container labeling machine comprises a single horizontal conveyor, a label applying apparatus, a star wheel, a label wrapper and at least one indexing mechanism, said single horizontal conveyor supplying at least one upright container to said star wheel in a straight line and taking away said upright container from said star wheel in said straight line upon release from said star wheel, said star wheel comprising a pair of parallel spaced apart plates affixed to a central axle, said spaced apart plates fitted with a plurality of rollers journaled only in said spaced apart plates, said rollers disposed at apices of points of said star wheel, said apices of points of said star wheel defining pockets therebetween, said star wheel receiving said upright containers between said rollers of adjacent apices, said indexing mechanism comprising a plurality of stop pins alternately engaged by independently operating fingers thus directly controlling a start and stop action of said star wheel and directly aligning said star wheel to present said upright container aligned with an axis of said label wrapper, said star wheel maintaining said upright container in said straight line while said label applying apparatus applies a label to said upright container against a wrapping belt of said wrapper, wherein said indexing mechanism has said plurality of stop pins disposed circumferentially about said central axle on an underside of a base plate of said pair of spaced apart plates of said star wheel, said plurality of said pockets greater in number than said stop pins by a factor of two, said wrapping belt perpendicular to said conveyor and moving in the same direction as said conveyor and said label wrapper adheres said label to said upright container.

7. A container labeling machine as in claim 6 wherein said star wheel further comprises a pair of spaced apart mounting plates provided with cusps between said points of said star wheel, said cusps sized for a range of diameters of said containers.

8. A container labeling machine as in claim 7 wherein said star wheel has at least three cusps.

9. A container labeling machine as in claim 8 wherein said star wheel has between four and twenty four cusps.

10. A container labeling machine as in claim 9 wherein said star wheel has eight cusps.

11. A container labeling machine as in claim 6 wherein said star wheel rotates upon an axle supported on an adjusting table.

12. A container labeling machine as in claim 6 wherein said indexing mechanism comprises at least one indexing cylinder moveable in an arcuate slot disposed in an adjusting table.

13. A container labeling machine as in claim 6 wherein said indexing mechanism comprises a pair of indexing cylinders moveable relative to one another in an arcuate slot disposed in an adjusting table.

14. A container labeling machine as in claim 13 wherein each indexing cylinder of said pair of indexing cylinders is provided with a finger that extends therefrom upon command from a controller, said indexing cylinders operating in tandem to serially extend said fingers thereof to engage against a stop pin of a plurality of stop pins carried on said star wheel to permit said star wheel to advance one cusp at a time.

15. A container labeling machine comprises a single horizontal conveyor which delivers a plurality of upright containers toward a labeling apparatus and a label wrapper, said labeling apparatus associated with an edge of said single horizontal conveyor, said label wrapper associated with said edge of said conveyor and disposed adjacent said labeling apparatus, said plurality of upright containers captured sequentially in cusps of a star wheel, said star wheel comprising a pair of parallel spaced apart plates affixed to a central axle, said spaced apart plates provided with cusps disposed thereinto from a peripheral edge, said cusps of said star wheel provided with rollers at apices thereof, said apices of points of said star wheel defining said cusps therebetween, said rollers free to rotate upon spindles rotatably mounted in spaced apart mounting plates of said star wheel, said cusps maintaining said upright container in contact with said label wrapper, said label wrapper spinning said upright container within said cusp of said star wheel, said labeling apparatus applying an edge of at least one label to said upright container against a wrapping belt of said wrapper, wherein said indexing mechanism has a plurality of stop pins disposed circumferentially about said central axle on an underside of one of said spaced apart plates of said star wheel, said plurality of said pockets greater in number than said stop pins by a factor of two, said wrapping belt perpendicular to said conveyor and moving in the same direction as said conveyor, said label wrapped about said upright container by said label wrapper to create a labeled container, said star wheel releasing said labeled container to said conveyor wherein said conveyor moves said labeled container therealong.

16. A container labeling machine as in claim 15 wherein said containers are maintained in a straight line through said star wheel.

* * * * *